United States Patent [19]

Clarke, Jr. et al.

[11] Patent Number: 4,668,947

[45] Date of Patent: May 26, 1987

[54] METHOD AND APPARATUS FOR GENERATING CURSORS FOR A RASTER GRAPHIC DISPLAY

[76] Inventors: Charles J. Clarke, Jr., 322 E. Eugie Ave., Phoenix, Ariz. 85022; Kevin P. Staggs, 4917 W. Dahlia Dr., Glendale, Ariz. 85304

[21] Appl. No.: 522,140

[22] Filed: Aug. 11, 1983

[51] Int. Cl.[4] ..... G09G 1/00

[52] U.S. Cl. ..... 340/709; 340/703; 340/723; 340/706

[58] Field of Search ..... 340/706, 709, 703, 723, 340/724, 750, 799

[56] References Cited

U.S. PATENT DOCUMENTS

| | | | |
|---|---|---|---|
| 4,323,891 | 4/1982 | Akashi | 340/709 |
| 4,445,194 | 4/1984 | Cason et al. | 340/709 |
| 4,454,507 | 6/1984 | Srinivasan et al. | 340/709 |
| 4,467,322 | 8/1984 | Bell et al. | 340/709 |
| 4,495,491 | 1/1985 | Postl | 340/709 |

FOREIGN PATENT DOCUMENTS

| | | | |
|---|---|---|---|
| 55-56246 | 4/1980 | Japan | 340/709 |

OTHER PUBLICATIONS

*IBM Tech. Disc. Bull.*, vol. 20, No. 5, "Cursor-Character Position Synchronization", Nicholson and Romon, Oct. 1977.

*Primary Examiner*—Gerald L. Brigance

[57] ABSTRACT

Method and apparatus for generating cursors for display by a color raster graphic system. The cursors displayed can assume any one of a plurality of forms. Each cursor has predetermined boundaries and includes all pixel positions of the raster within its boundaries. One pixel position is designated as the origin of the cursor and selected ones of the pixel positions for each form of the cursor will display the cursor color and intensity. The address of the origin of a cursor and its form are designated by the graphic controller of the system. The address of the origin is compared with the addresses of the pixels produced by the raster scan logic, and, when the same, the form number and the x and y coordinates, the addresses of the pixel positions of the cursor relative to the origin thereof, are produced and applied to a read-only memory which produces cursor control signals stored at the addressed locations of the cursor memory. The cursor control signals are produced in synchronization with the scanning of pixels, the positions of which correspond to selected cursor pixel positions of the cursor and are applied to the color look-up memory of the system. Such pixel control signals cause the color look-up memory to produce color control signals which cause pixels corresponding to a selected cursor pixel positions to be displayed in the cursor color and intensity to produce a cursor having the designated form with the origin of the cursor so produced being located at the designated address of a pixel in the raster.

8 Claims, 9 Drawing Figures

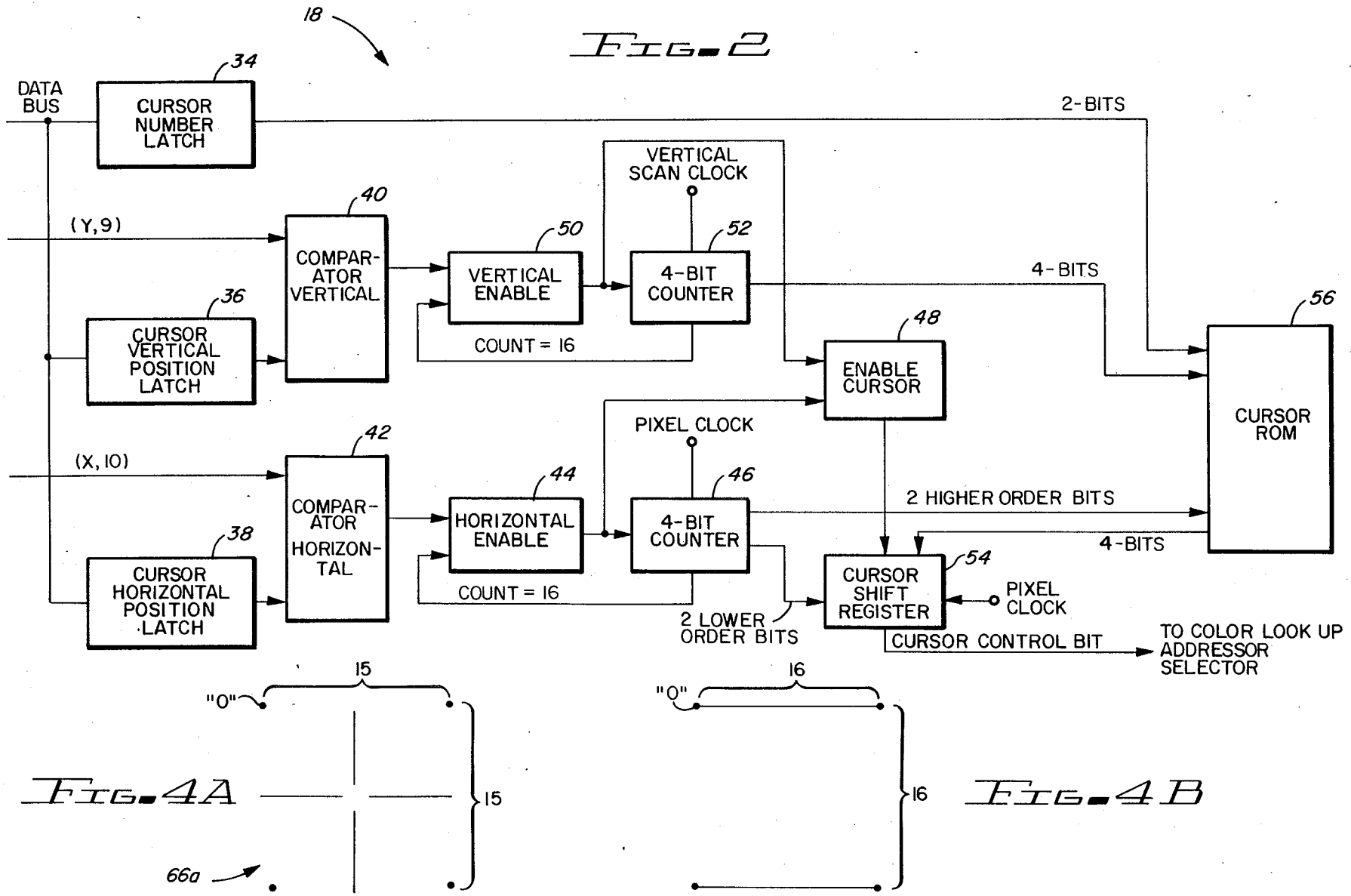
FIG. 2
18
DATA BUS
CURSOR NUMBER LATCH
34
CURSOR VERTICAL POSITION LATCH
36
CURSOR HORIZONTAL POSITION LATCH
38
(Y,9)
(X,10)
COMPAR-ATOR VERTICAL
40
COMPAR-ATOR HORIZON-TAL
42
VERTICAL ENABLE
50
HORIZONTAL ENABLE
44
COUNT = 16
COUNT = 16
VERTICAL SCAN CLOCK
4-BIT COUNTER
52
PIXEL CLOCK
4-BIT COUNTER
46
2-BITS
4-BITS
2 HIGHER ORDER BITS
2 LOWER ORDER BITS
ENABLE CURSOR
48
CURSOR SHIFT REGISTER
54
PIXEL CLOCK
CURSOR CONTROL BIT
CURSOR ROM
56
TO COLOR LOOK UP ADDRESSOR SELECTOR
FIG. 4B
16
16
"0"
FIG. 4A
15
15
"0"
66a

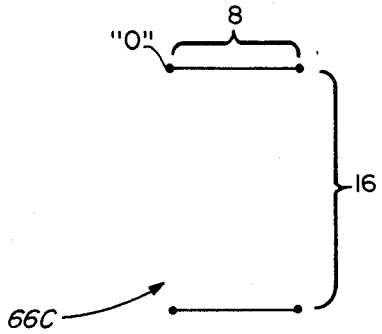
FIG. 4C
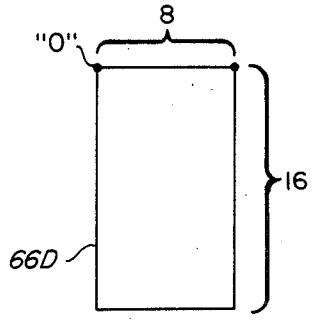
FIG. 4D
| | 0 | | | | 1 | | | | 2 | | | | 3 | | | |
|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 |
| 0 | 1 | 1 | 1 | 1 | 1 | 1 | 1 | 1 | 0 | 0 | 0 | 0 | 0 | 0 | 0 | 0 |
| 1 | | | | | | | | | | | | | | | | |
| 2 | | | | | | | | | | | | | | | | |
| 3 | | | | | | | | | | | | | | | | |
| 4 | | | | | | | | | | | | | | | | |
| 5 | | | | | | | | | | | | | | | | |
| 6 | | | | | | | | | | | | | | | | |
| 7 | | | | | | | | | | | | | | | | |
| 8 | | | | | | | | | | | | | | | | |
| 9 | | | | | | | | | | | | | | | | |
| 10 | | | | | | | | | | | | | | | | |
| 11 | | | | | | | | | | | | | | | | |
| 12 | | | | | | | | | | | | | | | | |
| 13 | | | | | | | | | | | | | | | | |
| 14 | | | | | | | | | | | | | | | | |
| 15 | 1 | 1 | 1 | 1 | 1 | 1 | 1 | 1 | 0 | 0 | 0 | 0 | 0 | 0 | 0 | 0 |
FIG. 5

METHOD AND APPARATUS FOR GENERATING CURSORS FOR A RASTER GRAPHIC DISPLAY

BACKGROUND OF THE INVENTION

1. Field of the Invention

This invention is in the field of computer-generated raster graphic systems and, more particularly, relates to improved methods and apparatus for displaying a cursor having any one of a plurality of possible forms in any position on the raster.

2. Description of the Prior Art

Raster scan CRT displays form a principal communication link between computer users and their hardware/software systems. The basic display device for computer-generated raster graphics is the CRT monitor which is closely related to a standard television receiver. To achieve the full potential of raster graphic systems, such systems require digital computational support substantially in excess of that provided by the typical CRT monitor. The development of large-scale integrated circuits and microcomputers makes it possible to control such displays at affordable prices. Typically, each picture element (pixel) of a substantially rectangular array of such elements of a CRT comprising the raster is assigned a unique address, which address is comprised of the x and y coordinates of each pixel in the array. Information to control the display of a pixel, its color and intensity, pixel control information, is stored in a random-access pixel memory at a location having an address corresponding to that of the pixel. The source of such pixel control information is typically a microcomputer located in a graphic controller. Such pixel control information may include the address in a color look-up memory at which location there is stored binary control signals which are used to control the intensity and color of each pixel of the array as it is scanned.

The horizontal and vertical sweep signals of the raster scan are digitized to produce the addresses of the pixels as scanned. The binary address signals produced by the raster scan logic of the system are applied to the pixel memory into which the graphic controller has previously written the pixel control signals, or information, determinative of its display. The pixel memory produces such signals in synchronization with the scanning of the addressed pixel by the CRT monitor by the system. The pixel control signals stored in the addressed location of the pixel memory are an address in the color look-up memory and are applied to the color look-up memory. Digital color control signals stored in addressable locations of the color look-up memory are read out of the addressed locations of the color look-up memory in response thereto. The digital color control signals are converted to analog signals by digital-to-analog (D/A) converters, and the analog signals produced by the converters are applied to the three color guns of the typical CRT monitor to control the intensity and color of each pixel of the raster as it is scanned.

Most raster graphic systems have the capability of displaying a cursor, a movable marker, in the raster. Prior art graphic systems known to applicants produce a cursor by programming the graphic controller to write into the pixel memory at pixel addresses within the boundaries of the cursor, pixel control signals which cause selected pixels within the boundaries of the cursor to display the cursor color at the cursor intensity; thus forming the cursor. Such prior art raster graphic systems typically limit the positions in which a cursor can be displayed to a character cell of 8×12 pixels, for example.

Writing pixel color information into a pixel random-access memory to cause a cursor to be displayed in the raster significantly increases the amount of communication between the graphic controller of the system and the pixel memory.

The problem is not only that of writing into the pixel random access memory at addressable memory locations which correspond to the raster addresses of the selected cursor pixel positions, control signals that will cause the pixels forming a raster to be displayed in the cursor color and intensity, but to store elsewhere, any pixel control signals stored in those addressable locations when cursor control signals are written into them, or any pixel control signals that may be subsequently written into those pixel memory locations by the system graphic controller until such time as the cursor is moved to a new position in the raster or turned off. When a cursor moves, or is turned off, the most recent pixel control signals stored elsewhere must then be written into their proper locations in the pixel memory. Providing the capability of displaying a cursor in prior art systems also increases the complexity of programming the graphic controller.

Thus, there is a need in color raster graphic systems to provide the capability of producing a cursor which can assume any of a plurality of forms without the need for the graphic controller storing and updating as needed the pixel control information stored at the locations into which cursor pixel control information is to be written and then restoring such pixel color information when the cursor is moved or no longer displayed. There is also a need to provide such systems with the capability of positioning the cursor with respect to any pixel of the raster, and of providing a method and apparatus for producing a cursor that functions properly in a system which has an interlaced vertical scan.

SUMMARY OF THE INVENTION

The present invention provides both method and apparatus for displaying a cursor on a color raster graphic system. To avoid the necessity of having the graphic controller writing cursor pixel control information into the pixel memory for each pixel corresponding to each cursor position within the boundaries of the cursor to be displayed in the desired cursor color and intensity, cursor pixel control signals are stored in a cursor memory. The addresses of the cursor control signals in the cursor memory are a function of the location of each cursor pixel position within the boundaries of the cursor relative to one such position which is designated as the cursor origin and of the number of the form of the cursor to be displayed. The graphic controller, when it is commanded to display a cursor of a given form, produces a cursor binary number identifying the form, or type, of cursor to be displayed and the x and y binary coordinates of the pixel of the raster which coincides with the origin. Cursor control logic, which includes a cursor memory, each time the address of the pixel being scanned coincides with the origin of the cursor, the cursor control logic begins producing addresses in the cursor memory of cursor pixel positions within the boundary, or envelope, of the cursor relative to the origin of the cursor. These addresses are applied to the cursor memory. The cursor memory in response thereto produces cursor pixel control signals which are applied to the color look-up address selector in synchronization with the scanning of pixels whose address correspond to pixel positions of the cursor relative to the origin of the cursor. These cursor control signals cause the pixels corresponding to selected cursor pixel positions to be displayed in the cursor color and intensity. As a result, a cursor of the desired form is produced with its origin coinciding with that of a pixel the address of which was produced by the controller.

It is, therefore, an object of this invention to provide an improved method and apparatus for generating cursors for a raster graphic system in which the memory I/O requirements to produce the cursor are minimized.

It is another object of this invention to provide improved method and apparatus for producing cursors in a raster graphic system in which the form of the cursor can be readily changed.

It is yet another object of this invention to provide improved method and apparatus for producing cursors in a raster graphic system in which the cursor can be placed relative to any pixel of the raster.

It is still another object of this invention to provide improved methods and apparatus for producing cursors in the raster graphic system which will function with an interlaced vertical scanner.

BRIEF DESCRIPTION OF THE DRAWINGS

Other objects, features and advantages of the invention will be readily apparent from the following description of a preferred embodiment thereof, taken in conjunction with the accompanying drawings in which:

FIG. 2 is a schematic block diagram of the cursor display logic of the invention;

FIGS. 4*a* through 4*d* illustrate various forms of a cursor;

FIG. 5 is a schematic diagram illustrating the organization of a cursor memory.

DETAILED DESCRIPTION OF THE INVENTION

Figure 1:
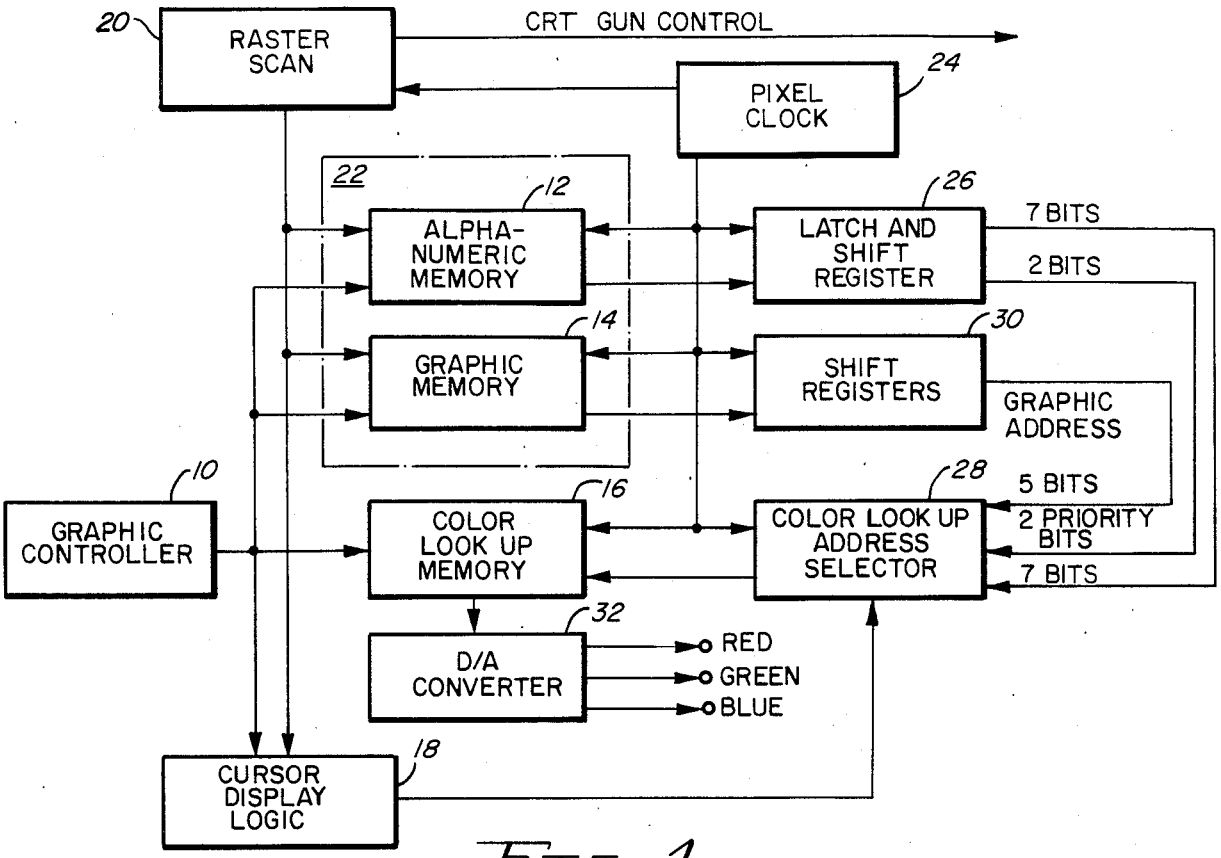
FIG. 1 is a schematic block diagram of a raster graphic system with details of the display device omitted.

In FIG. 1, there is illustrated apparatus for controlling the images displayed by, or the display of, a computer-generated raster graphic system. Graphic controller 10 has the capability of writing into random-access alphanumeric memory 12, graphic memory 14, color look-up memory 16, and cursor display logic 18, binary digital information, or signals, that is used to control the intensity and color of each picture element, pixel, of a conventional color CRT monitor which is not illustrated. Raster scan logic 20 of a conventional CRT monitor includes conventional digitizing circuits which digitize the horizontal and vertical sweep signals of the CRT monitor so that for each pixel on the face of the CRT there is an address. To uniquely identify each of the 640 pixels in each of the 480 horizontal lines of a standard CRT raster requires a 19-bit address with the x component comprising 10 bits and the y component 9 bits. The x address corresponds to the ordinate and the y to the abscissa of the pixels of the substantially rectangular raster. While in FIG. 1 alphanumeric memory 12, graphic memory 14, and color look-up memory 16 are indicated as being separate, they may be combined, or located, in a single conventional random-access memory. For this application, alphanumeric memory 12 and graphic memory 14 are collectively referred to as pixel memory 22. Pixel clock 24 produces a clock pulse each time that a pixel in the raster is scanned. The output of pixel clock 24 is used to read data from memories 22 and 16, as well as by the control circuitry of this invention including cursor display logic 18, as will be described below.

In the system illustrated, with each clock pulse produced by pixel clock 24, 7 bits of an alphanumeric color address are transmitted from latch and shift register 26 to color look-up address selector 28 with two priority bit, Pr0 and Pr1. Simultaneously, 5 bits of a graphic color address are transmitted to color look-up address selector 28, with one bit being shifted out of each of the shift registers 30 with each pixel clock pulse. Based on the values of the two priority bits, Pr0 and Pr1, the color look-up address selector 28 will apply to color look-up memory 16 an eight-bit address with the 7 bits of the alphanumeric color address, or the 5 bits of the graphic color address being the lower order bits of a color look-up memory address.

In color look-up memory 16 at locations having addresses corresponding to the color addresses applied by selector 28, there are stored color control signals which are used to control the intensity of the electron beams of the color guns of a conventional color CRT monitor and which determine the color and intensity of, or the display of, each pixel of the array as it is scanned. An 8-bit byte is stored in color look-up memory 16 at locations corresponding to the color addresses applied. In synchronism with the scanning of each pixel of the array, or raster, an 8-bit byte, the color control signal, is read out of color look-up memory 16 and applied to D/A converters 32. D/A converters 32 convert 6 of the 8 binary signals into analog signals for controlling the intensity of the red, green and blue electron beam guns of a conventional CRT monitor. In addition, in the preferred embodiment, two bits of the color control signal are applied to a fourth D/A converter which converts these two bits into a monochrome analog signal that can be used to produce a permanent record of the raster display using conventional equipment, as is well known in the art.

In FIG. 2, details of cursor display logic 18 for a non-interlaced raster scan are illustrated. Graphic controller 10, when commanded by a user, will write into cursor number latch 34 the number assigned to the desired form of cursor to be displayed. Graphic controller 10 also writes into cursor vertical position latch 36 the Y coordinates of the origin of the cursor and into cursor horizontal position latch 38 the X coordinates of the origin. These X and Y coordinates are the address of a pixel in the raster of the system which corresponds to that of the origin "O" of the cursor. The Y coordinate stored in latch 36 is applied as one input to vertical comparator 40. The other input is the Y coordinate of the address of the pixel being scanned as produced by raster scan logic 20. Similarly, the X coordinate of the origin stored in latch 38 is applied as one input to horizontal comparator 42, and the other is the X coordinate of the address of the pixel being scanned as produced by raster scan logic 20. When the X coordinate of a pixel being scanned is the same as the X coordinate of the origin of the cursor to be displayed stored in latch 38, comparator 42 will produce a horizontal compare signal. The horizontal compare signal is applied to the horizontal enable flip flop 44, which when set by the horizontal compare signal produces a horizontal enable signal. The horizontal enable signal is applied to horizontal counter circuit 46 and cursor enable circuit 48. In the preferred embodiment, counter 46 is a 4-bit counter and cursor enable circuit 48 is an And gate. Pixel clock signals from pixel clock 22 are applied to counter 46 so that the output of counter 46 changes with each pixel clock signal. When sixteen pixel clock signals are counted after the horizontal enable signal is produced, or the count equals sixteen, a count equals sixteen signal is applied to the reset input of horizontal enable circuit 44 which resets it, stopping the counter.

When the Y coordinate of the pixel of the raster being scanned equals the y coordinate of the origin of the cursor as stored in latch 36, vertical comparator 40 produces a vertical compare signal. The vertical compare signal is applied to a vertical enable flip flop 50 which sets it. As a result, vertical enable flip flop 50 produces a vertical enable signal which is applied to vertical counter 52 and to cursor enable gate 48. Counter 52, a 4-bit counter in the preferred embodiment, when enabled by the vertical enable signal, counts vertical scan clock pulses which are applied to counter 52. When sixteen such vertical scan clock signals are counted, a count equals sixteen signal is applied to the reset terminal of flip flop 50. When both the vertical and horizontal enable circuits 50 and 44 are set, cursor enable circuit 48 produces a cursor enable signal which is applied to cursor shift register 54.

Cursor control bits, or signals, are stored in addressable locations of cursor memory 56. In the preferred embodiment, cursor memory 56 is a read-only memory having an eight-bit address and stores four cursor control bits in each addressable location. The eight-bit address for cursor memory 56 is made up of two bits, the cursor number, from cursor number latch 34, four bits from vertical counter 52, the vertical component, and the two higher order bits of the horizontal counter 46, the horizontal component. The lower two order bits of horizontal component from counter 46 are applied to shift register 54, as are pixel clock signals from pixel clock 22. When the cursor enable signal from gate 48 is true, register 54 receives from cursor memory 56 four cursor control bits every fourth clock period. Cursor shift register 54 will produce, or shift out, a cursor control signal during each clock period in synchronization with the scanning of the corresponding pixels by the system. The two lower order bits of horizontal counter 46 are used to count the cursor control bits of each of the four cursor control bits shifted into the shift register 54 by enabling register 54 to store four cursor control bits as read out of the addressed location of cursor memory 54. This happens, in the preferred embodiment, when the lower two order bits produced by counter 46 are both logical zeros.

Figure 3:
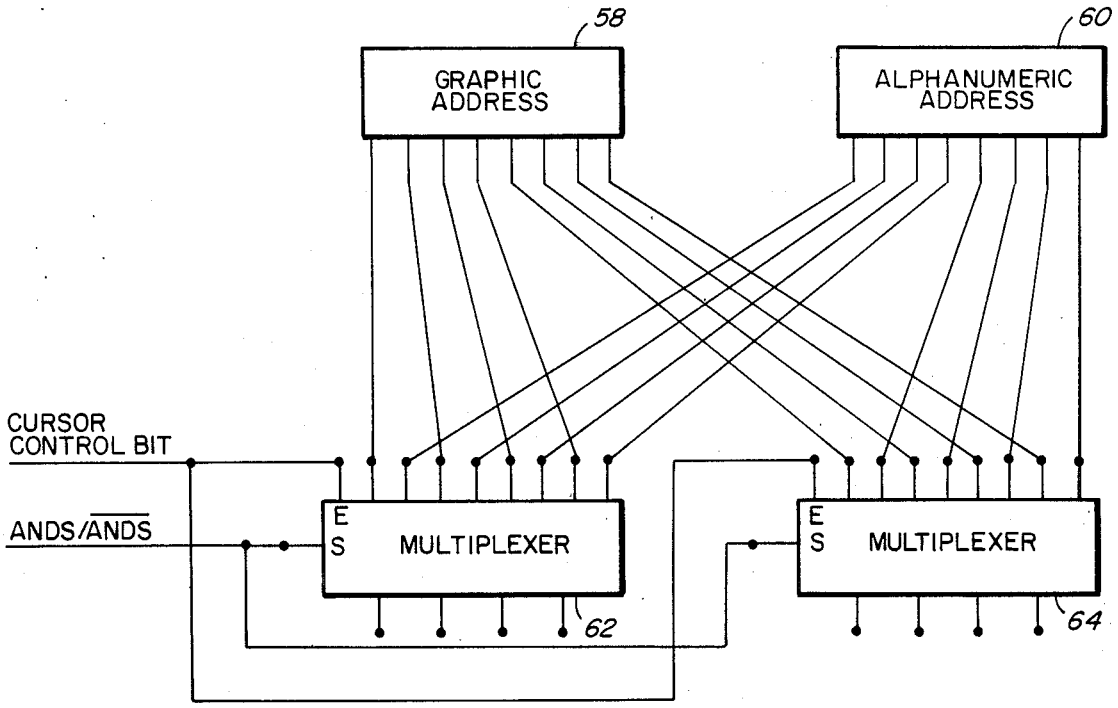
FIG. 3 is a schematic block diagram of a portion of the color look-up address selector circuit of the system as modified to operate with the cursor display logic.

In FIG. 3, a portion of color look-up address selector 28 is illustrated. For a more complete description of the system of FIG. 1 and of address selector 28, the disclosure of copending application Ser. No. 06/340,141, filed Jan. 18, 1982, which issued as U.S. Pat. No. 4,490,797 on Dec. 25, 1984, and entitled "Method and Apparatus for Controlling the Display of a Computer Generated Raster Graphic System", by Kevin P. Staggs and Charles J. Clarke, Jr., and assigned to the same assignee as that of this application, is hereby incorporated by reference into this application.

An eight-bit color look-up memory address is stored in graphic address register 58 and in alphanumeric address register 60. Since the graphic and alphanumeric addresses applied to selector 28 need not be of eight bits, higher order bit positions are forced to predetermined logic values so that the output of selector 28 is an eight-bit address. The outputs of registers 58, 60 are applied to one of two eight-bit multiplexers 62, 64. The eight bits selected by multiplexer 62, 64 are determined by the value of the alphanumeric display signal AnDs applied to the select terminal "S" of multiplexer 62, 64. If AnDs is true, the eight bits from alphanumeric display register 60 are applied to color look-up memory 16. If the signal AnDs is false, the eight bits from the graphic display register 58 are applied to color look-up memory 16. Cursor control bits from shift register 54 are applied to the enabled terminal "E" of multiplexer 62, 64, and, when true, force all the outputs of multiplexer 62, 64 to logical zeros. Stored in the zero address location of color look-up memory 16 are the color control signals that determine the color and intensity of the pixels forming the cursor.

In FIGS. 4A–D, there are illustrated four forms that the cursor 66 may take. In the preferred embodiment, cursors 66 can have up to 16 pixels to a side. Cursor **66*a* illustrated in FIG. 4A which forms a set of cross hairs, however, has fifteen pixels to a side with each line segment displaying the cursor color and intensity having seven pixels. In FIG. 4B, cursor 66*b* has the top and bottom rows of 16 pixels each displaying the cursor color at the cursor intensity. In FIG. 4C, cursor 66*c* has 8 pixels in the top and bottom rows displaying the cursor color and intensity. In FIG. 4D, cursor 66*d*** is in the form of a rectangle of $8\times16$ pixels.

In the preferred embodiment, the origin "O" of a cursor is the pixel position in the upper left-hand corner of the $16\times16$ pixels positions forming a cursor 66. In cursor 66a, the pixel corresponding to origin "O" is not displayed in the cursor color and intensity. In all other of the forms illustrated, it is. Obviously, cursors 66 can have forms other than those illustrated and the number of forms can also be varied.

In FIG. 5, there is illustrated a memory map for a single pixel form. In this particular illustration the memory map is that of cursor **66*c* illustrated in FIG. 4C. Logical ones are written into the bit positions 0–7 of rows 0 and 15. All other bit positions of the segment of cursor memory 56 for this form will be logical zeros. The origin corresponds to bit positions 0, 0 as illustrated in FIG. 5**.

Figure 6:
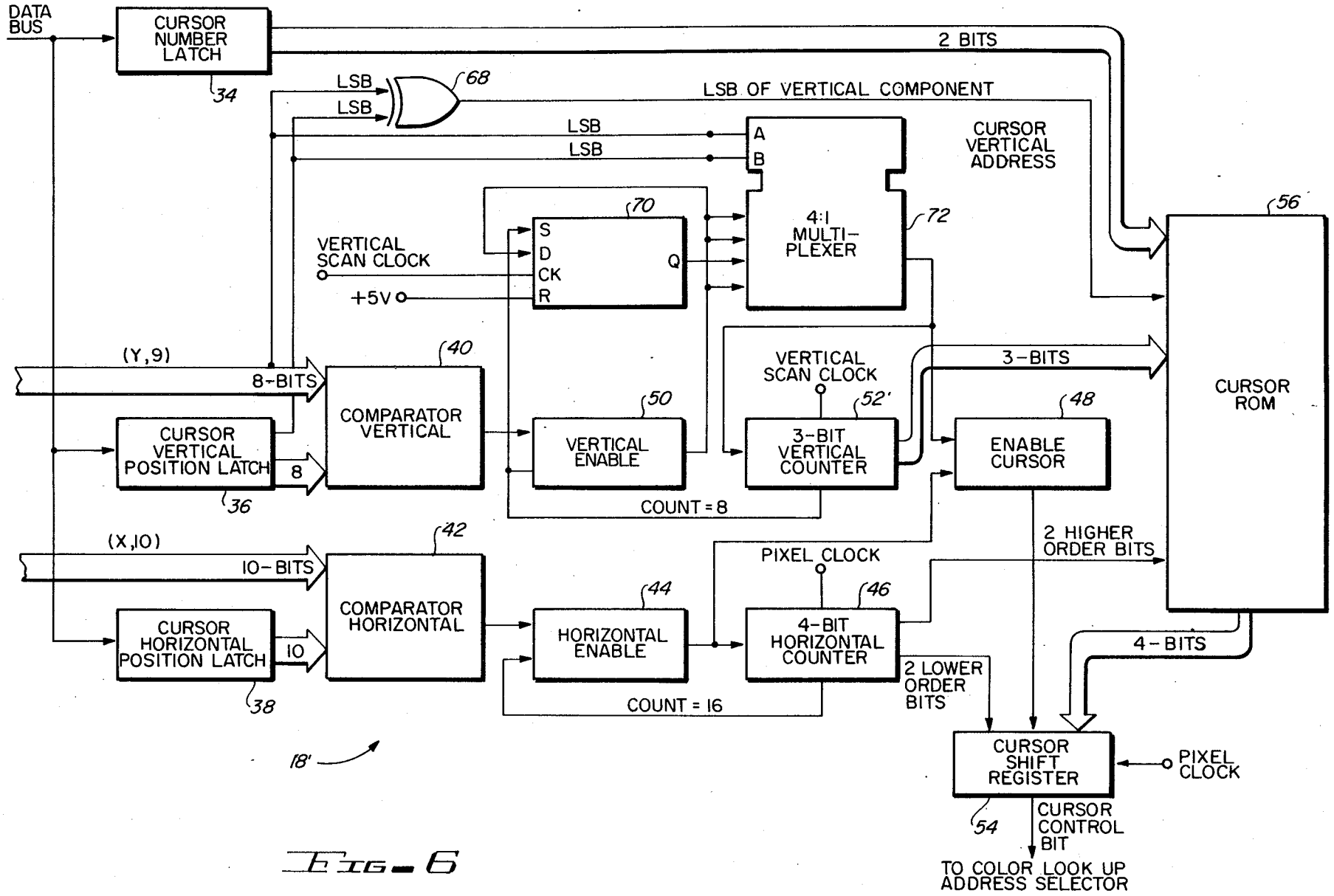
FIG. 6 is a view similar to that of FIG. 2 showing a modification of the cursor display logic for use with an interlaced vertical scan.

In FIG. 6, there is illustrated a modification of cursor display logic 18' for use when the vertical raster scan of the CRT monitor is interleaved. When the vertical scan is interleaved, all even-numbered horizontal lines are scanned in succession followed by all the odd-numbered lines. The least significant bit (LSB) of the y coordinate, or line address, which is also known as the odd/even frame bit, remains constant through each frame, or scan, of the set of odd or even lines. Interleaving the vertical scan creates a problem for the cursor display logic, particularly when the origin is located on an odd line since only the upper eight bits of the nine-bit y coordinate of the cursor origin are compared with the upper eight bits of the y coordinates of the pixel being scanned by comparator 40. Without modification, cursor display logic 18 would not start on the odd line, but on the even line. To solve this problem, the frame bit produced by raster scan logic 20 and the LSB of the y coordinate of the origin stored in cursor vertical latch 36 are applied to exclusive OR circuit 68. The output of gate 68 is the LSB of the y component of the address applied to cursor ROM 56. Another modification of cursor display logic 18' is that vertical counter 52' is a three-bit counter. In the modification of FIG. 6, the y component of the address signals applied to ROM 56 consists of three bits from counter 52' and one, the LSB, from gate 68.

Another problem that occurs when the vertical scan is interlaced is the need to delay by one line, one vertical scan clock pulse, or end-of-line timing pulse, production of the vertical enable signal when the cursor origin is located on an odd-numbered line of the raster and the frame bit is even. The circuitry that accomplishes this includes D flip-flop 70 and 4-1 multiplexer 72.

The frame bit of the pixel being scanned and the least significant bit of the y coordinate of the origin of the cursor are applied to the A and B terminals of multiplexer 72 and select which of the four inputs is applied to enable cursor gate 48 and vertical counter 52'. To do this, the output of vertical enable flip-flop 50 is applied to the D input terminal of flip-flop 70 and to three of the four input terminals of multiplexer 72. The fourth input to multiplexer 72 is the Q output of flip-flop 70. The set terminal of flip-flop 70 has applied to it the count equals eight signal produced by the three-bit vertical counter 52' which also resets flip-flop 50. The clock signal input of flip-flop 70 has applied to it the vertical scan clock pulse produced by raster scan logic 20.

The circuit involving exclusive OR gate 68 makes certain that the least significant bit of the y component of the cursor address applied to cursor ROM 56 is such that cursor control signals read out of cursor ROM 56 and produced by shift register 54 begin when the line of pixels being scanned has the same y coordinate as that of the origin of the cursor. Similarly, the circuit involving flip-flop 70 and multiplexer 72 will delay by one horizontal scan line the application of a vertical enable signal to counter 52' and gate 48 if the y coordinate of the cursor origin is an odd binary number and the frame bit is even.

From the foregoing, it is clear that the method and apparatus of this invention permit a raster graphic system to display any one of several forms of a cursor while imposing the minimum of requirements on the graphic controller. Changing the form of a cursor can be accomplished by replacing cursor ROM 56. Increasing the size of cursor memory 56 also makes it possible to increase the number of forms of cursor that can be displayed if other appropriate changes are made to cursor display logic 18, 18'. Further, the cursor display logic of this invention can be modified to function properly with an interlaced, or interleaved, vertical scan.

What is claimed is:

1. A method of generating a cursor for a color raster graphic system having a display device which includes a substantially rectangular array of picture elements (pixels) with each pixel of the array having a unique pixel address, and means for periodically scanning each pixel of the array, the cursor having predetermined boundaries and comprising cursor pixel positions within the cursor's boundaries, one cursor pixel position being designated as an origin, selected cursor pixel positions displaying a cursor color at a cursor intensity to create a cursor, said color raster graphic system producing a pixel address of a pixel in the array of the display device substantially as the pixel having that address is scanned, said system responsive to the production of each pixel address in the array producing color control signals which determine the color and intensity of a pixel as it is scanned, comprising the steps of:

specifying a pixel address for the origin of a cursor;

comparing the pixel address of the origin of the cursor with the pixel address of each pixel of the array of pixels as each pixel of the array is scanned;

producing a cursor enable signal when the address of a pixel being scanned is the same as that of the origin of the cursor;

identifying, responsive to the production of a cursor enable signal, each cursor pixel location relative to the origin;

producing a cursor control signal each time a pixel is scanned, the address of which corresponds to a selected cursor pixel position; and causing the pixel being scanned each time a cursor control signal is produced to display the cursor color at the cursor intensity.

2. A method of generating a cursor for a color raster graphic system having a display device which display device includes a substantially rectangular array of picture elements (pixels) with each pixel of the array having an "X" and a "Y" coordinate, the "X" and "Y" coordinates forming a pixel address, and means for periodically scanning each pixel of the array of pixels, the cursor having predetermined boundaries and comprising cursor pixel positions within a cursor's boundaries, one cursor pixel position being designated as an origin of the cursor, selected cursor pixel positions displaying a cursor color at a cursor intensity to create a cursor, a cursor having a plurality of different forms, said color raster graphic system producing a pixel address of a pixel in the array of the display device substantially as a pixel having that address is scanned, said system responsive to the production of each pixel address in the array producing color control signals which determine the color and intensity of a pixel as it is being scanned; comprising the steps of:

specifying the form of a cursor and the pixel address of the origin of the cursor;

comparing the pixel address of the origin of the cursor with the pixel address of each pixel as each pixel of the array is scanned; and producing a cursor enable signal when the pixel address of a pixel being scanned is the same as the specified pixel address of the origin of the cursor;

identifying responsive to a cursor enable signal being produced, each cursor pixel location relative to the origin;

producing a cursor control signal each time a pixel is scanned, the address of which corresponds to a selected cursor pixel position for the specified form of cursor; and causing the pixel being scanned, each time a cursor control signal is produced, to display the cursor color at the cursor intensity.

3. Apparatus for generating cursors for a color raster graphic system, said system including a display device having a raster of pixels with each pixel of the raster having a pixel address, and means for periodically scanning each pixel in the raster to cause the pixels to display a given color at a given intensity, said cursors having predetermined boundaries and consisting of cursor pixel positions within a cursor's boundaries, one cursor pixel position being the origin of a cursor and selected cursor pixel positions within the cursor's boundaries displaying a predetermined cursor color at a predetermined cursor intensity, the selected cursor pixel positions conforming to one of a plurality of predetermined cursor forms, said system producing a pixel address of a pixel substantially as a pixel is scanned, the pixel address of each pixel as produced by the system being used to produce a color address in a color look-up memory for each pixel substantially as it is being scanned, the color look-up memory producing color control signals responsive to each color address applied thereto, the color signals determining the color and intensity displayed by each pixel as it is scanned comprising:

means for specifying the form of a cursor and the pixel address of the origin of the cursor;

means for comparing the pixel address of the origin of a cursor with the pixel address of each pixel of the raster as each pixel of the raster is scanned and producing a signal identifying when the pixel address of a pixel being scanned equals the pixel address of the origin of the cursor;

means for utilizing said signal to identify each pixel of the raster which corresponds to a cursor pixel position;

means for producing a cursor control signal each time a pixel of the raster is scanned, the location of which corresponds to a selected cursor pixel position for the specified form of a cursor; and means responsive to each cursor control signal for causing the color look-up memory to produce color control signals which cause the pixel being scanned to be displayed in the selected cursor color and at the selected cursor intensity.

4. Apparatus for generating a cursor for display by a color raster graphic system having a display device including a raster of pixels with each pixel of the raster having a pixel address said display means periodically scanning each pixel of the raster, said cursor having predetermined boundaries, and including all cursor pixel positions within its boundaries, one of the cursor pixel positions being designated as an origin of the cursor, said cursor having a plurality of forms, said system including a graphic controller for producing binary signals for controlling the operation of the raster graphic system and raster scan logic for producing a pixel address of a pixel substantially as that pixel is scanned comprising:

first means for storing a pixel address of a pixel with which the origin of the cursor is to coincide;

second means for comparing the pixel address of the origin of a cursor stored in the first means with the pixel address of each pixel as produced by the raster scan logic and for producing an address compare signal when both addresses are the same;

addressable cursor memory means for storing at addressable locations thereof cursor control bits for each cursor position for each form of a cursor; and means responsive to the production of an address compare signal for forming addresses of addressable locations of the cursor memory means in which are stored cursor control bits for one form of a cursor, for reading out of said cursor memory means cursor control bits stored at an addressed location, and for producing a cursor control bit as a pixel corresponding to a cursor pixel position of the cursor is scanned; and means responsive to each control bit having a predetermined binary value for causing the pixel being scanned when the control bit having that value is produced to be displayed in a predetermined color with a predetermined intensity.

5. The apparatus of claim 4 in which the addressable cursor memory means is a read-only memory.

6. The apparatus of claim 5 in which the cursor addressable memory means stores four control bits at each addressable location.

7. The apparatus of claim 4 in which the number of forms of the cursor is four.

8. Apparatus for generating movable cursors for display by a color raster graphic system having a display device, said display device including a raster of pixels, with each pixel of the raster having a binary pixel address, said display device including means for periodically scanning each pixel of the raster, a cursor having cursor pixel positions located within a predetermined boundary of the cursor, there being a one-to-one correspondence between a cursor pixel position and pixels of the raster located within the boundaries of the cursor, one of the cursor pixel positions being designated as an origin of a cursor, said cursor having a plurality of forms with each form having a cursor number, said system including a graphic controller for producing binary signals for controlling the operation of the raster graphic system and raster scan logic for producing binary pixel addresses of pixels of the raster substantially as each pixel is scanned for an interlaced display, each of said addresses including an "X" and a "Y" coordinate of a pixel of the raster the "Y" coordinate having a least significant bit, the least significant bit of the "Y" coordinate being an odd/even frame bit, comprising:

first latch means for storing a cursor number;

second latch means for storing the "Y" coordinate of the pixel address of the origin of the cursor;

third latch means for storing the "X" coordinate of the pixel address of the origin of a cursor;

first comparator means for comparing the higher order bit positions of the "Y" coordinate of a cursor stored in the second latch means and the higher order bit positions of the "Y" coordinate of the address of a pixel being scanned as produced by the raster scan logic and for producing a vertical compare signal when they are the same;

second comparator means for comparing the "X" coordinate of the cursor origin stored in the third latch means and the "X" coordinate of a pixel being scanned as produced by the raster scan logic and for producing a horizontal compare signal when they are the same;

first circuit means to which the vertical and horizontal compare signals are applied for producing a vertical enable signal and a horizontal enable signal;

an addressable cursor memory means for storing at addressable locations having a binary address cursor control bits for each cursor pixel position for each form of a cursor, the binary address including a form number of a cursor, a "Y" component and an "X" component of a cursor pixel position forming a cursor pixel position address in the cursor memory means;

vertical counter means for producing higher order bits of the "Y" component of a cursor pixel position address when enabled by a vertical enable signal;

exclusive OR gate means to which the least significant bit of the "Y" coordinate of the origin of a cursor stored in the second latch means and the frame bit of the "Y" coordinate of a pixel being scanned are applied, the output of exclusive OR gate means being the least significant bit of the "Y" component of the cursor pixel position address applied to the cursor memory means;

means for delaying the production of a vertical enable signal for one horizontal sweep cycle when the least significant bit of the origin of the cursor is a logical one and the frame bit of the pixel being scanned is a logical zero;

horizontal counter means for producing the "X" component of the cursor memory address when enabled by the horizontal enable signal;

a cursor enable gate which produces a cursor enable signal when the vertical enable signal and horizontal enable signals are produced concurrently, and shift register means to which lower order bits of the "X" component of the cursor pixel location address and cursor control bits stored in an addressable location of the cursor memory means are applied, for producing a cursor control bit as each pixel corresponds to a cursor pixel position of the cursor is scanned, said control bits having a predetermined binary value causing the pixel of the pixel array being scanned concurrently to be displayed in a predetermined color and with a predetermined intensity.

* * * * *

UNITED STATES PATENT AND TRADEMARK OFFICE

CERTIFICATE OF CORRECTION

PATENT NO. : 4,668,947

DATED : May 26, 1987

INVENTOR(S) : Charles J. Clarke, Jr., Kevin P. Staggs

It is certified that error appears in the above—identified patent and that said Letters Patent is hereby corrected as shown below:

Col. 5, line 58, change "54" to --56--.

Col. 6, line 20, change "enabled" to --enable--.

Col. 9, line 14, before "signals" insert --control--.

Signed and Sealed this

Twenty-second Day of September, 1987

*Attest:*

DONALD J. QUIGG

*Attesting Officer* *Commissioner of Patents and Trademarks*

UNITED STATES PATENT AND TRADEMARK OFFICE

CERTIFICATE OF CORRECTION

PATENT NO. : 4,668,947

DATED : May 26, 1987

INVENTOR(S) : Charles J. Clarke, Jr., et al

It is certified that error appears in the above—identified patent and that said Letters Patent is hereby corrected as shown below:

ON THE TITLE PAGE INSERT:

-- [73] ASSIGNEE: Honeywell Inc., Phoenix, AZ --.

Signed and Sealed this

First Day of December, 1987

*Attest:*

DONALD J. QUIGG

*Attesting Officer*

*Commissioner of Patents and Trademarks*